United States Patent [19]

Mesa

[11] Patent Number: 4,641,459

[45] Date of Patent: Feb. 10, 1987

[54] PARKING SPACE BLOCKING DEVICE

[75] Inventor: Jesus G. Mesa, Cadiz, Spain

[73] Assignee: Progesco, S.A., Cadiz, Spain

[21] Appl. No.: 836,436

[22] Filed: Mar. 5, 1986

[30] Foreign Application Priority Data

Mar. 25, 1985 [ES] Spain ..... 285.601

[51] Int. Cl.[4] ..... E01F 13/00

[52] U.S. Cl. ..... 49/35; 49/131; 49/49; 256/1; 404/6

[58] Field of Search ..... 256/1, DIG. 2; 49/131, 49/35, 49; 404/6

[56] References Cited

U.S. PATENT DOCUMENTS 3,600,853 8/1971 Goldberg ..... 49/35
3,673,734 7/1972 Goldberg ..... 49/49 X
3,750,331 8/1973 Renaux ..... 49/131 X
4,190,379 2/1980 Sosa ..... 49/35 X

*Primary Examiner*—Andrew V. Kundrat
*Attorney, Agent, or Firm*—Frost & Jacobs

[57] ABSTRACT

A device to block car parking spaces comprising a collapsible gate and a collapsible anchoring post; the gate comprises a flat structure including at least one pole and a crossbar mutually perpendicular to one another, the pole being pivotally jointed at its bottom end to a base plate affixed to the ground and affixed at its top end to the crossbar which is parallel to the jointing axis of the pole; the anchoring post is pivotally jointed at its base to a base plate by an axis perpendicular to the axis of the base plate for the pole; and the crossbar is of such length as to rest with one of its free ends on the free end of the anchoring post when the post and gate are in a vertical position. A blocking lock is provided at the mutual points of support of the crossbar and post.

3 Claims, 2 Drawing Figures

PARKING SPACE BLOCKING DEVICE

BACKGROUND OF THE INVENTION

The present invention consists of a device to block car parking spaces in order to prevent their use by persons other than the owners or assigned users.

One of the inherent problems of car parking lots, both underground and ground level parking lots, is the lack of means to insure that the parking spaces will always be available to their owners or users. This is in view of the possibility that a driver other than the owner can occupy such space and as a consequence, the owner finds himself without a space to park when he arrives.

The purpose of this invention is to provide a device which avoids this inconvenience, allowing the owner of a parking space to reserve it for his sole use, and preventing other vehicles from using it when empty.

At the same time, once the owner has parked his vehicle in his parking space, and once the device of the invention is set in a blocking position, the vehicle cannot be taken out except by the owner or an authorized person cleared by the owner, in such a way that the invention acts as an antitheft protective device.

Another aim of this invention is to provide a device for the stated purposes which is of a simple and strong design and which can be easily operated to shift quickly from the blocking position to the open position, and vice versa.

SUMMARY OF THE INVENTION

According to the invention, the parking space blocking device comprises a collapsible gate and an anchoring post which is also collapsible. Both the gate and the post are jointed at their bases to plates or footings affixed to the ground through two mutually perpendicular axes.

The gate comprises a flat structure including at least a pole and a crossbar which are mutually perpendicular in a T configuration. The gate can also include two poles and a top crossbar in a horizontal F configuration.

The pole or the poles are pivotally jointed at their bases to plates affixed to the ground, and at their tops to the crossbar which extends in a position parallel to the joint axis of the above-mentioned pole or poles. Moreover, this crossbar will be of a length such as to allow it to rest at one of its ends on the free end of the post, when said post and said gate are both in the vertical position.

The crossbar of the gate and the post are furnished with a blocking lock at their mutual support joints.

The post is provided with a pivotal jointing axis which is perpendicular to the joint axis of the gate, so that said post can collapse toward said gate.

The component characteristics of the inventional device of the invention and the advantages it embodies will be more readily understood through the following description which includes references to the enclosed drawings where a possible way of implementation is presented. This is given as a nonlimiting example.

DETAILED DESCRIPTION

Figure 1:
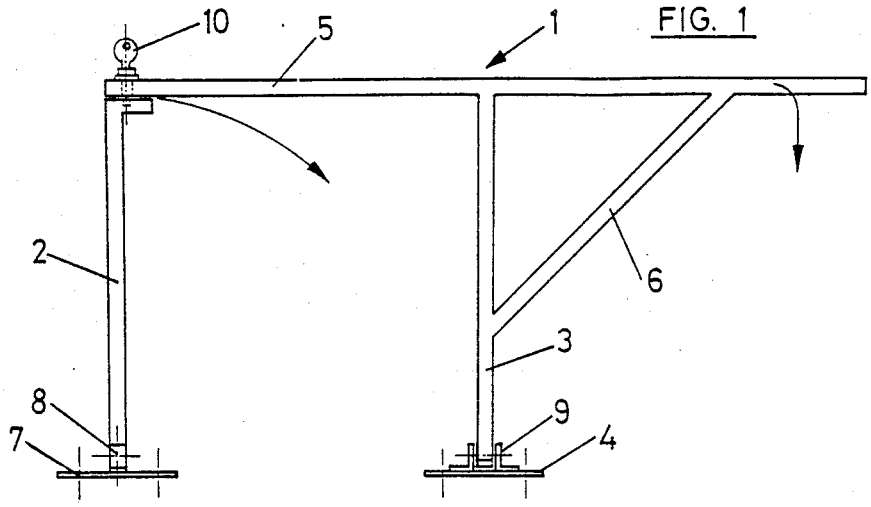
FIG. 1 is a side elevation of a device according to the invention, in a blocking position.

As the drawings show, the car parking space blocking device is constituted by a collapsible gate indicated generally at 1, and an anchoring post 2.

The gate 1 comprises a flat structure which in the example illustrated in these drawings has a T configuration, with a pole pivotally jointed at its bottom end to an anchoring plate 4, while at its top end it is affixed to a crossbar 5. This construction can be reinforced by a tie member 6.

As far as the post 2 is concerned, it is pivotally jointed at its bottom end to a second anchoring plate 7, with a shaft 8 perpendicular to the jointing shaft or axis 9 of the gate 1 to the plate 4.

The crossbar 5 is of such a length as to rest in the upright blocking position on the top end of the post 2, both the crossbar and the post, at their points of mutual support, being provided with a blocking lock 10.

Figure 2:
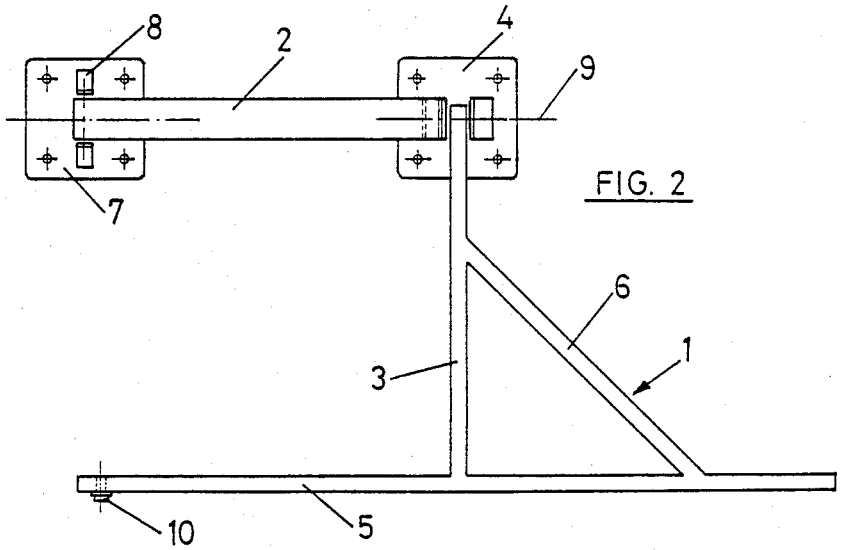
FIG. 2 is a top view of the device of FIG. 1 in a collapsed or open position.

Separation between the pole 3 and the post 2 will be such as to allow the post 2 to collapse toward the gate 1, as is illustrated in FIG. 2. In this way, when the gate and the post collapse, the space occupied by these components is reduced, thus allowing a vehicle to pass easily over them.

In the position shown in FIG. 1, the device of the invention, after locking by use of the key 10, acts as a safety device to prevent any other vehicle from occupying the parking space even though it is empty, or else to prevent the parked vehicle from being taken out by a person other than its owner.

The crossbar 5 of the gate 1 can be of a sufficient length to block two parking spaces, in which case the gate can have two anchoring poles 3.

Both the post 2 and the gate 1 can be manufactured from high-resistance and high-hardness shapes of rectangular section.

In regard to the lock, it can be of any type, but it should preferably include a vertical latch or bolt adapted to be shifted by simple pressure for insertion in the housing on the post 2, this being enough to open it upon inserting the proper key.

After sufficiently describing the nature of the invention as well as the way to implement it, it is stated that the aforementioned disclosure is susceptible to modifications in details as long as they do not alter its fundamental principle.

I claim:

1. A device to block car parking spaces, comprising a collapsible gate and a collapsible anchoring post; the gate and post being pivotally jointed at their bases about two perpendicular and independent axes to base plates or footings affixed to the ground; the gate comprising a flat structure including at least one pole and a crossbar mutually perpendicular to each other, with said pole pivotally jointed at its bottom end to one of said base plates, while its top end is affixed to the crossbar which extends in a postion parallel to the jointing axis of said pole and is of such length as to rest with one of its ends on the free end of said post when said post and said gate are in a vertical position; and a blocking lock on mutual points of support of said crossbar and post.

2. The device according to claim 1, wherein the pole of said gate and said post are separated by a length approximately equal to the height of said post.

3. The device according to claim 1, wherein said flat structure has a T configuration whose stem is jointed at its free end to said base plate affixed to the ground, while one of its wings rests on the top end of said post when said post and said flat structure are in a vertical position.

* * * * *